US006557636B2

(12) United States Patent
Cernocky et al.

(10) Patent No.: US 6,557,636 B2
(45) Date of Patent: May 6, 2003

(54) METHOD AND APPARATUS FOR PERFORATING A WELL

(75) Inventors: Edward Paul Cernocky, Houston, TX (US); Allen J. Lindfors, Inyokern, CA (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/896,430

(22) Filed: Jun. 29, 2001

(65) Prior Publication Data

US 2003/0000703 A1 Jan. 2, 2003

(51) Int. Cl.[7] ..... E21B 43/117
(52) U.S. Cl. ..... 166/297; 166/55.1
(58) Field of Search ..... 166/297, 299, 166/55.1, 63; 175/4.52, 4.53

(56) References Cited

U.S. PATENT DOCUMENTS

| | | | | |
|---|---|---|---|---|
| 4,538,680 A | | 9/1985 | Brieger et al. | 166/55 |
| 4,619,333 A | | 10/1986 | George | 175/4.52 |
| 4,768,597 A | | 9/1988 | Lavigne et al. | 175/451 |
| 4,790,383 A | | 12/1988 | Savage et al. | 166/297 |
| 4,911,251 A | | 3/1990 | George et al. | 175/4.54 |
| 4,917,187 A | | 4/1990 | Burns et al. | 166/297 |
| 4,924,952 A | | 5/1990 | Schneider | 175/4.54 |
| 4,969,525 A | | 11/1990 | George et al. | 166/297 |
| 5,050,672 A | | 9/1991 | Huber et al. | 166/55 |
| 5,287,924 A | | 2/1994 | Burleson et al. | 166/297 |
| 5,355,957 A | | 10/1994 | Burleson et al. | 166/297 |
| 5,423,382 A | | 6/1995 | Barton et al. | 166/297 |
| 6,009,947 A | * | 1/2000 | Wilson et al. | 166/299 |
| 6,082,450 A | | 7/2000 | Snider et al. | 166/55.2 |
| 2002/0088620 A1 | * | 7/2002 | Lerche et al. | 166/297 |
| 2002/0125011 A1 | * | 9/2002 | Snider et al. | 166/297 |

FOREIGN PATENT DOCUMENTS

| | | | |
|---|---|---|---|
| WO | 00/05774 | 2/2000 | H01M/6/18 |

OTHER PUBLICATIONS

Rustad, Barry, et al., "Casing–Conveyed Perforating Tested," *Hart's E&P.*, Feb. 2000, pp. 85–87.

* cited by examiner

*Primary Examiner*—William Neuder

(57) ABSTRACT

A method and apparatus for perforating tubular members coaxial outside and inside surfaces with a continuous wall extending therebetween attaches at least one explosive charge in direct contact with the wall of the tubular with at least one detonation device in communication with the explosive device. A control station in wireless and cableless communication with the at least one detonation device selects from radio waves, infrared waves, acoustic waves, optical light waves, seismic waves, and combinations thereof to activate the at least one detonation device.

28 Claims, 3 Drawing Sheets

METHOD AND APPARATUS FOR PERFORATING A WELL

BACKGROUND OF THE INVENTION

1. The Field of the Invention

The present invention relates to a method and apparatus for perforating the walls of a well bore and, in particular, to a method and apparatus which will provide accurate and controlled perforating of a tubular such that annular pressures between tubulars can be relieved allowing completion of a well and stimulation of multiple zones and/or formations.

2. The Prior Art

Once a well bore has been drilled, utilizing the conventional technique of a drilling string with a drill bit secured to the lower free end, the well is completed by positioning a casing string within the well bore. This increases the integrity of the well bore and provides a path to the surface for the produced fluids. The casing string is normally made up of individual lengths of relatively large diameter metal tubulars secured together by any suitable means, for example screw threads or welds. Conventionally, the casing string is cemented to the well face by circulating cement into the annulus defined between the casing string and the well face. The cemented casing string is subsequently perforated to establish fluid communication between the formations of interest, those containing hydrocarbons, and the interior of the casing string. Perforating has conventionally been performed by means of lowering a perforating gun, having at least one shaped charge positioned within a carrier, down inside the casing string and then firing the charge via wireline control from the surface of the earth. A perforating gun may be constructed to be of any length. The perforating gun is lowered within the casing on wireline or tubing to a point adjacent the zone of interest and the shaped explosive charge is detonated to penetrate or perforate both the casing and the formation. This establishes fluid communication between the cased well bore and the zone of interest. The resulting perforations extend through the casing, cement, and a short distance into the formation. The perforating gun is either removed from the well bore or dropped to the bottom thereof The formation is then often stimulated by any one of a number of well-known means to enhance production of hydrocarbons therefrom.

Examples of the known perforating devices can be found in U.S. Pat. Nos. 4,538,680 to Brieger et al; U.S. Pat. No. 4,619,333 to George; U.S. Pat. No. 4,768,597 to Lavigne et al; U.S. Pat. No. 4,790,383 to Savage et al; U.S. Pat. No. 4,911,251 to George et al; U.S. Pat. No. 5,287,924 to Burleson et al; U.S. Pat. No. 5,423,382 to Barton et al; and U.S. Pat. No. 6,082,450 to Snider et al. All of these relate to perforating guns which are lowered within a casing string carrying explosive charges which are detonated to perforate the casing outwardly. This had the advantage of leaving the inside of the casing relatively unobstructed since debris and ragged edges would be outwardly directed by the detonations of the charges.

In the late 1990s, successes were found with casing conveyed perforating guns in which the guns and control lines were attached to the outside of the casing. One disadvantage of this approach is that the externally conveyed elements are subject to damage during normal run-in operations. A second disadvantage is the perforations leaving ragged shards extending inwardly causing obstructions on the inside of the casing.

PCT application PCT/US00/05774, to Snider et al, describes another attempt to perforate a tubular from the outside. This differs from the above mentioned perforating from the outside of the casing in that Snider et al propose a perforating gun separate from and exterior to the casing to be perforated. When the Snider et al perforating gun is detonated, portions of the gun act in a manner similar to shrapnel to perforate the casing string. This is not a satisfactory solution to the problem of perforating tubulars in that it raises the possibility of a very ragged perforating which could easily destroy the structural integrity of the casing string, particularly in view of the fact that it utilizes portions of the casing itself to perforate the side of the casing furthest from the perforating gun. This can also result in a ragged inner surface of the casing which could damage or prevent passage of downhole tools and instruments. Perforating a casing from the inside raised this consideration to a much lesser degree.

Frequently a well penetrates multiple zones of the same formation and/or a plurality of hydrocarbon bearing formations of interest. It is usually desirable to establish communication with each zone and/or formation of interest for injection and/or production of fluids. Conventionally, this has been accomplished in any one of several ways. One way is to use a single perforating gun which is conveyed by wireline or tubing into the well bore and an explosive charge fired to perforate a zone and/or formation of interest. This procedure is then repeated for each zone to be treated and requires running a new perforating gun into the well for each zone and/or formation of interest. One alternative is to have a single perforating gun carrying multiple explosive charges. This multiple explosive charge gun is conveyed on wireline or tubing into the well and, as the gun is positioned adjacent to each zone and/or formation of interest, selected explosive charges are fired to perforate the adjacent zone and/or formation. In another alternative, two or more perforating guns, each having at least one explosive charge, are mounted spaced apart on a single tubing, then conveyed into the well, and each gun is selectively fired when positioned opposite a zone and/or formation of interest. When the select firing method is used, and the zone and/or formation of interest are relatively thin, e.g., 15 feet or less, the perforating gun is positioned adjacent the zone of interest and only some of the shaped charges carried by the perforating gun are fired to perforate only this zone or formation. The gun is then repositioned, by means of the tubing, to another zone or formation and other shaped charges are fired to perforate this zone or formation. This procedure is repeated until all zones and/or formations are perforated, or all of the shaped explosive charges detonated, and the perforating gun is retrieved to the surface by means of the tubing.

However, the necessity of tripping in and out of the well bore to perforate and stimulate each of multiple zones and/or formations is time consuming and expensive. In view of this, multiple zones and/or formations are often simultaneously stimulated, even though this may result in certain zones and/or formations being treated in a manner more suitable for an adjacent zone and/or formation. Thus a need exists for apparatus and processes to perforate casing which is positioned within a well bore which eliminates the need to run perforating equipment in and out of the well when completing multiple zones and/or formations.

Disadvantages of the presently known methods of perforating are several, including: the perforating device itself may need to be retrieved; and the cabling systems to convey signals to the charges must be carried outside or inside the tubulars, either subjecting the cabling system to damage and/or taking up space. Protective means, such as wrap-around metal protectors, armored cable housings, or grooved casing couplings, must be used to avoid damaging externally mounted cabling systems, explosive charges and their respective detonating means. In order to perforate the adjacent formation, internally conveyed or mounted perforating systems necessarily also perforate the tubular within which they are conveyed which in certain instances, such as when trying to relieve annular pressure, is undesirable.

Accordingly, it is an object of the present invention to provide a method and apparatus for economically and effectively perforating and stimulating multiple zones and/or formations which are penetrated by a well.

It is another object of the present invention to provide a process and apparatus for completing a well wherein the casing is perforated to provide for fluid communication through the wall of the casing by means of a perforating gun assembly forming a portion of the casing string.

It is a further object of the present invention to provide a method and apparatus for completing and stimulating a cased well bore wherein shaped explosive charges are mounted in contact with, or at least partially embedded in, the casing wall so that a precise hole is formed without undue damage to the casing or unwanted internally directed projections left to interfere with passage of tools and/or instrumentation through the casing.

It is a still further object of the present invention to provide a method and apparatus for completing and stimulating a cased well bore wherein each shaped explosive charge is at least partially embedded in the casing wall so that a precise hole is formed without undue damage to the casing or unwanted internally directed projections left to interfere with passage of tools and/or instrumentation through the casing.

It is still another object of the present invention to provide a method for perforating a casing utilizing wireless communication from the surface to initiate detonation of the respective explosive charges of the perforating assembly, the wireless communication employing coded signaling to prevent errors in detonation.

SUMMARY OF THE INVENTION

The present invention provides a method and apparatus for perforating a well casing without the disadvantages of known perforating tools. The present apparatus for perforating a well casing comprises: a tubular having coaxial outside and inside surfaces with a closed wall extending therebetween; at least one explosive charge in contact with the outside surface of the wall of the tubular; at least one detonation device in communication with the at least one explosive device; at least one programmable logic interface to arm and fire the detonation device; and a control station in wireless and cableless communication with the at least one programmable logic interface whereby a coded signal from the control station is received by the logic interface to detonate the at least one explosive charge.

The present invention also provides a method for perforating a well bore, the method comprising the steps of providing a well bore; running a tubing string down the well bore, wherein said tubing string comprises at least one perforating tubular having coaxial outside and inside surfaces with a wall extending therebetween; providing at least one explosive charge in contact with the outside surface of the wall; providing at least one detonation device in communication with the at least one explosive charge; providing at least one programmable logic interface to arm and fire the detonation device; providing a control station in wireless and cableless communication with at least one of the at least one programmable logic interface; lowering the production tubing string until the at least one perforating tubular is adjacent to a predetermined zone to be perforated; sending a coded wireless signal from the control station to the at least one programmable logic interface to arm and fire at least one detonation device thereby detonating at least one explosive charge and perforating the well bore and, optionally, at least one perforating tubular; and producing liquids, gases, or a combination thereof through the production tubing string.

The method can also be used for venting annular pressure in a well bore by the steps of providing a well bore; providing a casing string having at least one self-perforating tubing with coaxial outside and inside surfaces with a wall extending therebetween; providing at least one explosive charge in direct contact with or at least partially penetrating the outside surface; providing at least one detonation device in communication with the at least one explosive charge; and providing at least one programmable logic interface to arm and fire the at least one detonation device; running the casing string into the well bore; providing a production tubing having an outside surface; running production tubing inside the casing thereby forming an annular space between the outside surface of the production tubular and the inside surface of the casing; providing a control station in wireless and cableless communication with at least one of the at least one programmable logic interfaces; and sending a coded wireless signal from the control station to the at least one least one programmable logic interface to detonate at least one explosive charge thereby perforating at least one self-perforating casing and the well bore, but not the production tubular; and allowing pressure to vent from the annular space to the formation via the now perforated casing.

BRIEF DESCRIPTION OF THE DRAWINGS

The present invention will now be described, by way of example, with reference to the accompanying drawings in which.

DETAILED DESCRIPTION OF THE INVENTION

The method and apparatus of the present invention provide for perforation of a tubing string and the adjacent formation without the need for conventional perforating guns and their related extensive downhole wiring or cables. The subject apparatus can best be described as a "self-perforating" production tubular or casing. What this means is at least one portion of the tubing making up the production tubing and/or casing itself carries the perforating charges and, after detonation, production continues through the now perforated tubing or casing.

Figure 1:
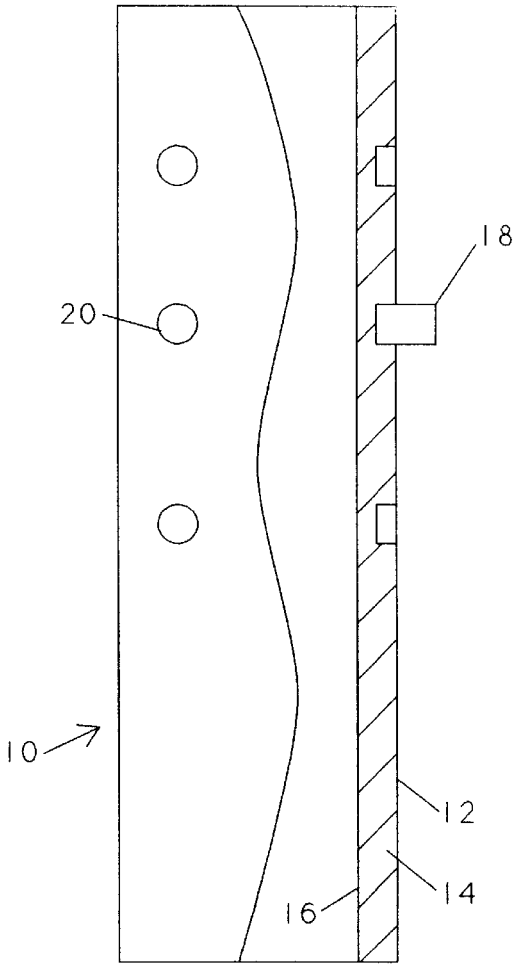
FIG. 1 is a side elevation, partially in section, of an embodiment of the invention utilizing explosive charges attached to a tubing wall.

Turning now to the drawings, as seen in FIG. 1, a tubular 10 is provided with an outside surface 12, a tubular wall 14, and an inside surface 16. Explosive charges and their associated detonators 18 are attached to the outer surface of the wall, preferably in blind bores 20. In wells, where space is at a premium, this embodiment allows the explosive charges to be set close to flush with the outside surface 12 thereby lessening the danger of damage to the explosive charges and their detonators during running of the tubular downhole.

The self-perforating tubing or casing of the present invention is made from standard tubular materials having coaxial outside and inside surfaces with a closed wall extending therebetween. At least one explosive charge is mounted in direct contact with the outside surface of the wall of the tubular. This contact may be a mechanical connection, such as, by adhering the explosive charges to the outside surface of the tubular; but preferably is by drilling receiving blind bores in the wall of the tubular and fixing the explosive charges into the respective blind bores; or by bracketing, banding or clamping the explosive charges to the outside surface of the tubular. The tubular itself may also be modified in other ways to carry the explosive charges. An example is to add one or more ribs to the outside of the tubular, preferably in a helical spiral around the outside surface. The explosive charges may then be placed within the ribs. Prefabricated, molded plastic sleeves could also be used to carry the explosive charges. Such sleeves could be made to attach to the outside surface of the tubular, for example in a clamping manner or as shrink wrap, and could be provided with additional features, such as molded channels to allow circulation of well fluids, for example cement slurry, through the annular space between the casing and the well bore.

Figure 2:
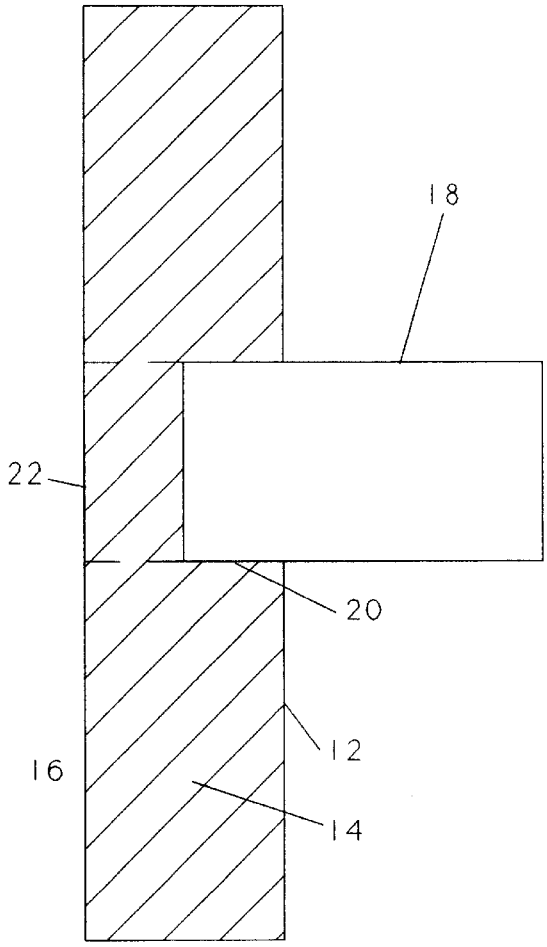
FIG. 2 is a detailed section through one of the shaped charges of the present invention.

FIG. 2 shows a cross section through an explosive charge 18 in accordance with the first embodiment. The tubular 10 is first prepared by boring a series of blind bores 20 about the circumference. These bores 20 can be in set geometric patterns, randomly spaced, aligned vertical rows, circumferential bands, etc. in accordance with the desired plan for perforating. The shaped explosive charges 18 are secured in their respective blind bores 20 by any known means, such as threading or affixing the explosive charge into the blind bore with an adhesive material. The explosive charges 18 are then connected to their respective detonating means (not shown) for single, multiple, sequential, etc. detonation in accordance with the plan for perforating. The detonating means are in wireless/cableless contact with control means (also not shown) at the surface. When the explosive charge 18 is detonated, it will blow a plug 22 (shown in phantom) from wall 14. This amounts to no-jet perforating.

This preferred method to perforate the pipe string uses an explosive charge to open a hole from outside to inside to create a flow path between the inside and outside of the pipe. A second explosive charge can, if so desired, be used to perforate outwardly through the annular space, which may be cement filled, into the formation or zone of interest. The present method can be considered "plugging" in that an explosive charge is set in contact with the casing wall, or in a partially penetrating blind bore drilled into the casing wall, and detonation of that explosive charge creates a stress riser that shears a steel "plug" out of the casing wall leave a hole of known geometry and size without burrs or splatter inside the casing that can block or damage equipment being run in the hole.

A key feature of the present system is the slim overall profile which does not increase borehole size requirements. A collar, sleeve or coating of a diameter greater than that of the casing and with channel(s) cut helically on its exterior surface can be used to provide protected clearance for the charge, receiver, and controller while allowing clearance for flow of fluids and slurries, for example cement, past the collar. A hole or holes can be partially drilled into the collar from the outside to provide a site for a stress riser when the perforating charge is ignited without substantially affecting the pressure rating of the casing string.

Figure 3:
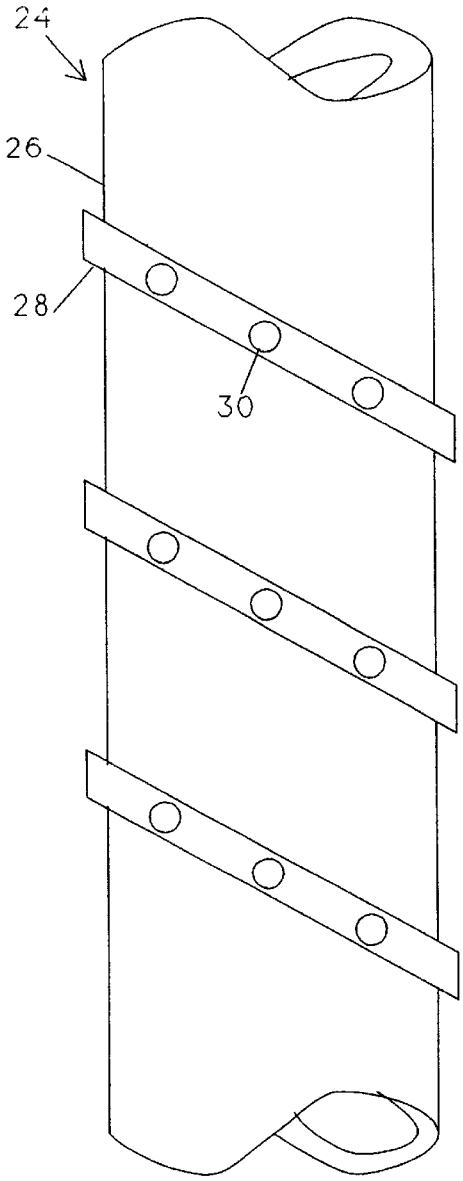
FIG. 3 is a side elevation of an embodiment of the invention utilizing external ribs containing the explosive charges.

In FIG. 3, a tubular 24 has an outside surface 26 and one or more ribs 28 wrapped around and secured to the outside surface. A plurality of explosive charges 30 are placed in recesses in the ribs 28 to lie against the outer surface 26. This embodiment maintains full strength of the tubular, as the wall is without the blind bores of the embodiment of FIG. 1, but has a slightly larger profile. However, the ribs 28 can be used to advantage by directing flow during casing running and cementing operations.

Figure 4:
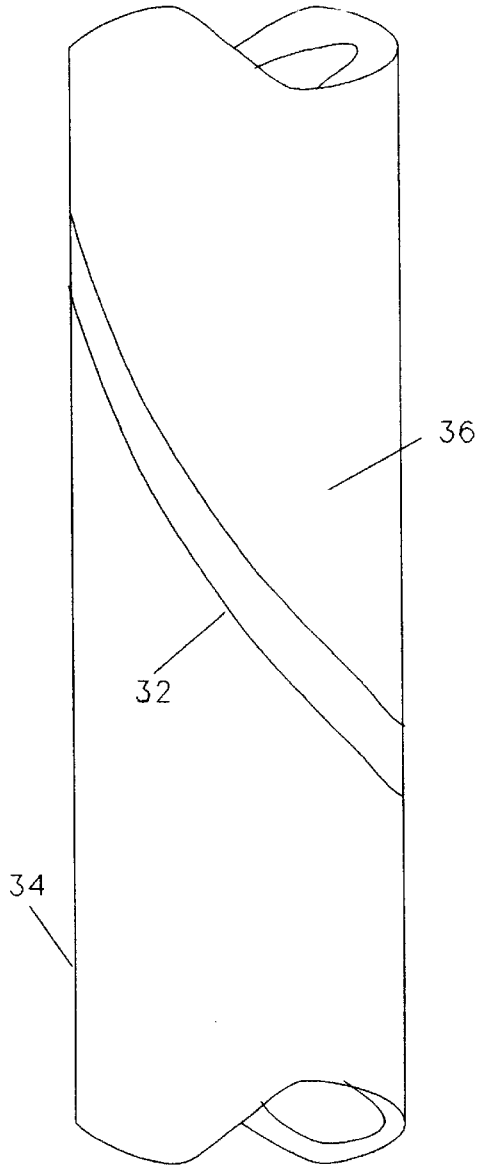
FIG. 4 is a side elevation of an embodiment of the invention utilizing explosive linear strip.

The embodiment of FIG. 4 utilizes a linear strip explosive charge 32 placed on and winding helically about the outside surface 34 of the tubular 36. Such helically arranged linear strip charges allow a greater surface area of rock/sand to be perforated, as compared to conventional "button" charges. The flexible strips may be oriented in a variety of patterns. Explosive strips may be constructed so that the force of the explosion is highly directional. When explosive linear strips are used, it is advisable to place them on the outside surface of the outermost tubing string, such as the casing, so that the force is directed outward and the structural integrity of the casing is not compromised. This is an important new advantage of the subject system.

With all of the above-mentioned embodiments of the present invention, the use of shaped explosive charges allows a controlled and directed explosive force thereby allowing use as a means to open holes to release annular pressure without damaging internal tubulars.

Figure 5:
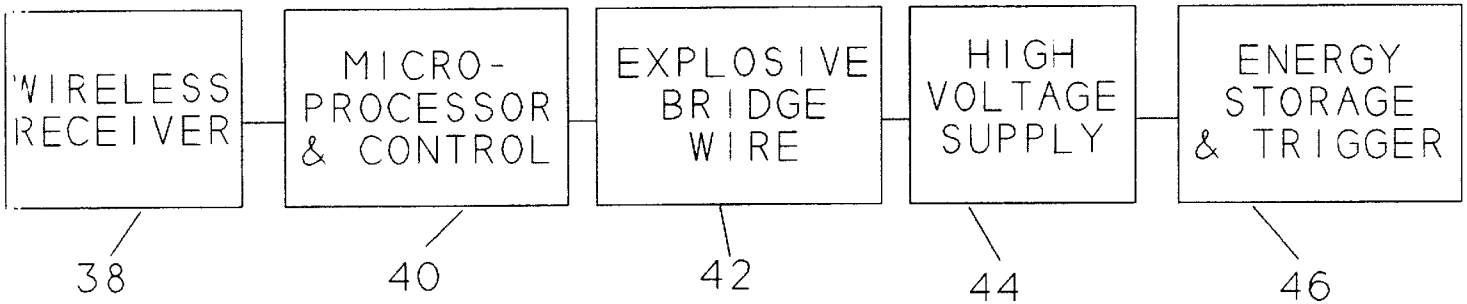
FIG. 5 is a block level schematic diagram of the programmable interface and detonation device.

FIG. 5 shows a schematic of the detonation device of the present invention including a wireless receiver 38; microprocessor and control 40; explosive bridge wire 42; high voltage supply 44; and energy storage and trigger means 46. A coded wireless signal from the control at the surface will be received by receiver 38, decoded by the micro processor 40 and, if the code designates that the respective explosive charge is to be detonated, sends a signal to the trigger means 46 which will supply high voltage to explosive bridge wire 42 to trigger detonation of the respective explosive charge.

Among the advantages of this system are: the coded signal allows selective detonation of the explosive charges individually, in sequence, in patterns, etc., and the wireless signal does not transmit the power to initiate detonation of the explosive charge thereby reducing the risk of accidental detonation of the explosive charge.

Figure 6:
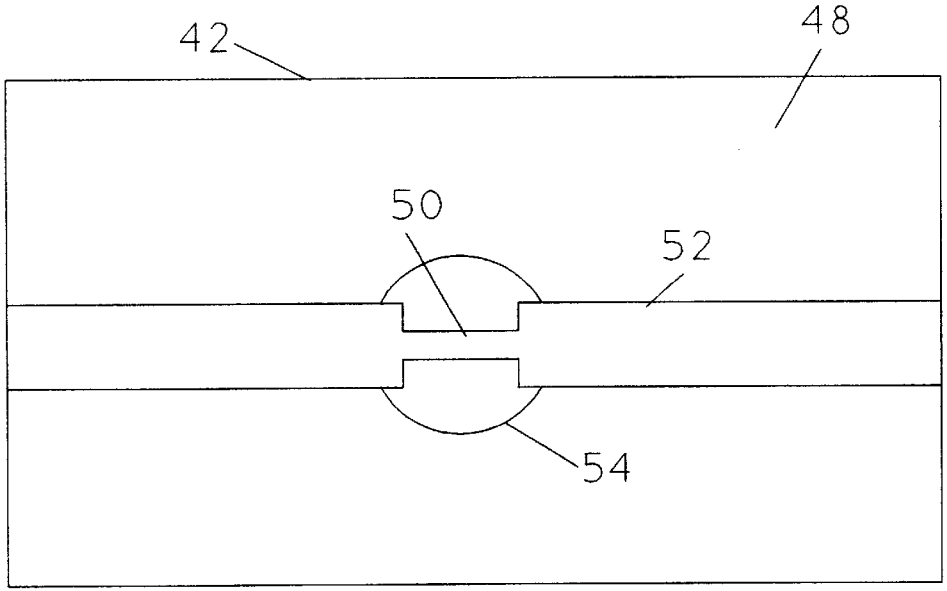
FIG. 6 is a detail plan view of the exploding bridgewire detonation device of the present invention.

FIG. 6 shows a detail of an explosive bridge wire 42, which can be compared to a printed circuit board 48 with the bridge portion 50 of the circuit 52 overlying an aperture 54, thus bridge. The bridge 50 has dimensions smaller than the rest of the circuit 52, so that, upon application of power to the circuit 52, the bridge 50 will flash vaporize causing detonation of the nearby explosive charge 18.

The explosive charge is in communication with a detonation device which receives signals, via a programmable logic interface, to detonate the explosive charge. The explosive charges may be programmed and/or wired to fire independently of each other, or several may be linked together, in parallel or in series, to fire together. One explosive charge or several explosive charges may be connected to a single detonator. The detonator is typically conveyed into the well as an attachment to the casing/tubing, but it may be remote, such as at the surface.

The present invention has one or more antenna (not shown) embedded in the well casing to facilitate wireless communication with the surface. Embedding antennas into the casing and adding instrumentation to the casing allows all wells thus equipped to have increased capabilities for monitoring and/or further processing. Embedding antennas into the casing avoids irregular inside surface topography and its related problems. This allows normal inside casing well operations to be performed in an unhindered fashion. The embedded antenna resides in a relief area machined into the inside of each connection. It is generally circular in shape, but could have substantially any shape or form including, but not limited to, a single wire, a loop of wire, or a coil of looped wire. The antenna forms an electrically isolated area from the casing itself The antenna can be designed to work with any frequency or communication protocol specified by the user. Many communication protocols and practical techniques exist for wireless communication through an empty or partially filled wave guide. The well bore casing would be such a wave guide. The antenna can be designed to work within any size of well casing, The antenna design, coupled with a properly designed transceiver unit, would allow more than one antenna to be embedded into the well casing, if so desired.

Build up of trapped annular pressure is a major threat when constructing subsea wells. In a conventional subsea well, there is no opportunity to vent trapped annular pressure. Conventional perforating equipment cannot be used since such equipment would also perforate the inner most tubular, which is intended to be a pressure barrier. The use of the subject self-perforating casing provides the capability for selectively perforating an outer casing string while leaving the innermost string in tact thereby providing a flow path for venting of pressure in an outward direction form the annular space in the formation.

The use of an explosive strip charge allows perforation of much increased surface area of rock/sand compared with the usual circular (hole) charge. The explosive strip charge may be axially or circular or spiral oriented with chosen pitch. The use of an explosive sip charge in conventional (internal to pipe) perforating is not possible because such a charge would cut a path along the casing, significantly decreasing the structural strength of the casing. Because the proposed strip charge lies outside the pipe, it is designed specifically to not reduce the structural strength of the casing, while cutting a strip of large surface area along the bore wall surface.

The use of molded plastic ribs attached to the outside of the casing allows fluids and slurries, for example cement, to be pumped around and be directed by the ribs. Either straight or spiral crests on the ribs hold the explosive charges in place and enclose means used to connect the explosive charges to their respective detonating devices.

The method for producing exploding bridgewire detonators uses both standard and nonstandard circuit board manufacturing techniques. Previous techniques to produce exploding bridgewires have used extremely fine wires of gold, copper, or other conductive material joined to conductors by a variety of known methods. The present method replaces the previous fine wires and attachment techniques with etched or plated circuit board traces. The exploding bridgewire trace is in contact with a small mass of low density explosive consisting of PETN, RDX, HMX or other secondary explosive to begin the detonation process. This small mass of low density explosive is in contact with a larger mass of high density explosive to complete the initiation process.

As a high voltage pulse is passed through the exploding bridgewire trace, the trace is vaporized and sends a shock wave into the low density explosive initiating detonation. The low density explosive in turn initiates the larger mass of high density explosive to complete the detonation train. The output from this secondary charge can then be used to initiate larger masses of explosives. Additionally, the initial mass of low density explosive may be in contact with the final mass of high density explosive to be used in an explosive device.

The circuit board trace for the exploding bridgewire is shown in FIG. 6. In the figure a wider trace that acts as a conductive path narrows down to the trace shown, the narrow trace acts as the exploding bridgewire. Variations in lengths, widths and thicknesses of the trace provide for tailoring of voltage and energy requirements for initiating the explosive. Variations of the trace sizes, types of explosives in contact with the traces, and densities of explosives are all considered to be pertinent to the method described.

The subject explosive bridge wire detonating system is a major improvement over the previously widely used primacord for detonation. The board can be built to withstand high operating temperatures, where primacord cannot be used because of its instability. The subject explosive bridge wire detonating system also provides a way to make selective perforating with conventional guns much cheaper and easier to operate. The digitally operated controller and downhole battery power source provide easy selectivity for the system which enables the perforator to be constructed safely offsite and run in the hole without having to wait for a complete well evaluation, improving safety and saving rig time. In completion intervals that may be impacted by gas and water contact within a producing interval, the selectivity allows the system to be run into and cemented in the well before log evaluation is completed because the guns would preferable overlap beyond the potential completion intervals.

The linear perforating charge increases the amount of formation exposed for completion. The linear charge is an outwardly directed jet perforator that is designed to penetrate the formation with a high velocity jet, not by expansion of gas. Also, the linear explosive charge is used in combination with the above discussed "plugging" explosive charges and is fired sequentially, first plugging holes in the casing and then firing the linear charge.

The coded wireless signal sent downhole in the present invention is used only to arm the explosive charges. The power to initiate the explosive charge comes from a battery positioned downhole as a part of the detonating system.

The present apparatus requires a control station and a wireless and cableless means for communicating between the control station and the detonation device. Any wireless or cableless communication method may be used including, but not restricted to, radio waves, infrared waves, acoustic waves, optical light waves, seismic waves, magnetic waves, or combinations thereof Wireless signals are conveyed through the tubular string wherein the wall of the tubular string acts as a waveguide. Alternatively, a ball containing a transponder may be dropped downhole, sending signals to the detonators for the explosive charges as it passes them If a "smart ball" or transponder is used, signals may vary as the smart ball progresses thus allowing only selected explosive charges to detonate.

The use of the subject apparatus varies only slightly if the tubular is production tubing or if it is casing. When perforating as part of a production tube or tubes, the perforating device is attached as part of the tool string and lowered into a well bore in the typical manner in which production tubulars are run into a well. The tubular(s) to which perforating device(s) are attached are placed within the tubing string such that, when the tubing string is in place, the perforating device(s) are adjacent to predetermined zones to be perforated. The explosive charges are detonated, as described above, by means of wireless and cableless communication. Once the perforation operation is complete, one may begin to produce or inject liquids, gases, or a combination thereof through the production tubing string or, if desired, through the production casing string.

When the self-perforating tube is a portion of the casing, the subject method varies only slightly. In the casing scenario the self-perforating casing is made part of the casing string and the casing string is set such that the at least one self-perforating casing is set adjacent a predetermined zone to be perforated. The self-perforating casing and its external charges are cemented into the well bore. Detonation of the explosive charges then takes place as previously described.

When tubing is run inside casing, an annular space is formed between the outside surface of the tubing and the inside surface of the casing. A pressure differential typically builds up in this annular space. Trapped annular pressure is a major threat to the mechanical integrity of certain wells, such as subsea wells. It is not desirable to perforate the innermost production tubing in such wells, for the purpose of relieving this pressure since the innermost tubing is used as a barrier to contain pressure. Conventional perforating equipment has the disadvantage of perforating both the tubing as well as the casing. The apparatus and method of the present invention have the further advantage of allowing one to selectively perforate an outer casing to relieve (vent) annular pressure during the operating life of the well. Explosive charges may be placed on the casing or on the outside wall of an outer production tubing string. By use of directional explosive charges, all force may be directed outward, so that only the outer strings are perforated, allowing annular pressure to vent, while the integrity of the inner production strings is maintained intact to provide the desired barrier.

The present invention may be subject to many modifications and changes without departing from the sprit or essential characteristics thereof The described embodiments should therefore be considered in all respects as illustrative and not restrictive of the scope of the present invention, as defined by the appended claims, without departing from its spirit or scope as set forth herein.

We claim:

1. An apparatus for perforating comprising:

a tubular having coaxial outside and inside surfaces with a continuous wall extending therebetween;

at least one explosive charge in contact with the wall of said tubular said at least one explosive charge being a linear strip charge attached to the outside surface of said tubular along a helical path;

at least one detonation device in communication with said at least one explosive device; and a control station in wireless and cableless communication with said at least one detonation device whereby a signal from said control station causes said at least one detonation device to detonate a selective one of said at least one explosive charge.

2. An apparatus according to claim 1 wherein each said at least one explosive charge comprises a plurality of explosive charges each capable of independent detonation.

3. An apparatus according to claim 1 wherein each said at least one explosive charge comprises a plurality of explosive charges grouped to detonate in a specific sequence.

4. An apparatus according to claim 1 wherein said control station is at a surface and said wireless and cableless communication is selected from radio waves, infrared waves, acoustic waves, optical light waves, seismic waves, magnetic waves, and combinations thereof.

5. An apparatus according to claim 1 wherein said tubular is a production tubular.

6. An apparatus according to claim 1 wherein said tubular is a well bore casing.

7. An apparatus according to claim 1 wherein said at least one explosive charge is fixed to the outside surface of said tubular.

8. An apparatus according to claim 1 wherein said at least one explosive charge is placed in direct contact with the wall of said tubular by securing the explosive charge into a blind bore in the wall of said tubular.

9. An apparatus according to claim 1 further comprising:

at least one rib secured helically around said outside surface of said tubular; and said at least one explosive charge is positioned in said at least one rib so as to contact said outer surface of said tubular.

10. A method for perforating a well bore, said method comprising the steps of:

providing a well bore;

providing a tubular string having at least one perforating tubular with coaxial outside and inside surfaces with a continuous wall extending therebetween, at least one explosive charge in contact with said wall, said at least one explosive charge being a linear strip charge attached to the outside surface of said tubular along a helical path, and at least one detonation means in communication with said at least one explosive charge;

providing a control station in wireless and cableless communication with at least one of said at least one detonation means;

running said tubular string downhole until said at least one perforating tubular is adjacent a predetermined zone to be perforated; and sending a signal from said control station to said at least one detonation device to detonate said at least one explosive charge thereby perforating said well bore and optionally said at least one perforating tubular enabling production of liquids, gases, or a combination thereof through said tubular string.

11. A method according to claim 10 wherein said perforating tubular has a plurality of explosive charges; and said detonation means is capable of independently detonating each of said plurality of explosive charges.

12. A method according to claim 10 wherein said perforating tubular has a plurality of explosive charges grouped to detonate in a specific sequence.

13. A method according to claim 10 wherein a control station is at a surface and communication between said control station and said detonation device is selected from radio waves, infrared waves, acoustic waves, optical light waves, seismic waves, and combinations thereof.

14. A method according to claim 10 wherein said at least one explosive charge is fixed to the outside surface of said perforating tubular.

15. A method according to claim 10 further comprising the steps of;

providing said perforating tubular with at least one blind bore on the outer surface thereof; and said at least one explosive charge is fixed in each respective at least one blind bore.

16. A method according to claim 10 further comprising the steps of:

securing at least one rib extending helically around said outside surface of said perforating tubular; and said at least one explosive charge is contained in said at least one rib.

17. A method according to claim 10 wherein said tubular string is a production tubing string.

18. A method according to claim 10 wherein said tubular string is a casing string.

19. A method according to claim 18 further comprising the step of:

running a production tubing inside said casing string thereby forming an annular space between said production tubing and said casing string, wherein detonation of said at least one explosive charge perforates only said casing string allowing reduction of annular pressure within said annular space.

20. A method according to claim 10 further comprising:

a production tubular string having at least one perforating tubular; and a casing string having at least one perforating tubular.

21. A method for venting annular pressure in a well bore comprising the steps of:

providing a well bore;

providing a casing string having at least one self-perforating tubing with an outside surface, an inside surface and a wall extending from said outside surface to said inside surface, at least one explosive charge connected to said outside surface, and at least one detonation device in communication with said at least one explosive charge;

running said casing string in said well bore;

providing a production tubing having an outside surface and running said production tubing inside said casing thereby forming an annular space between the outside surface of said production tubular and the inside surface of said casing;

providing a control station in wireless and cableless communication with at least one of said at least one detonation device; and sending a signal from said control station to said at least one detonation device and detonating said at least one explosive charge to perforate said at least one self-perforating casing and said well bore, but not said production tubular thereby allowing pressure within said annulus to vent out said perforated casing and well bore.

22. A method according to claim 21 wherein said self-perforating casing has a plurality of explosive charges, each said explosive charge capable of independent detonation.

23. A method according to claim 21 wherein said self-perforating casing has a plurality explosive charges grouped to detonate together.

24. A method according to claim 21 wherein said control station is at a surface and communication with said at least one detonator is selected from radio waves, infrared waves, acoustic waves, optical light waves, seismic waves, and combinations thereof.

25. A method according to claim 21 wherein said at least one explosive charge is secured to the outside surface of said self-perforating casing.

26. A method according to claim 21 wherein said at least one explosive charge is screwed into the wall of said self-perforating casing.

27. A method according to claim 21 wherein said at least one explosive charge is a curvilinear strip charge attached to the outside surface of said casing.

28. A method according to claim 21 further comprising the step of:

placing at least one rib helically around the outside surface of said casing and attaching it thereto; and said at least one explosive charge being contained in said at least one rib.

* * * * *